US005536919A

United States Patent [19]

Taheri

[11] Patent Number: 5,536,919

[45] Date of Patent: Jul. 16, 1996

[54] HEATING CHAMBER

[76] Inventor: Ramtin Taheri, P.O. Box 4316, Santa Clara, Calif. 95056

[21] Appl. No.: 343,196

[22] Filed: Nov. 22, 1994

[51] Int. Cl.[6] ..... H05B 3/66

[52] U.S. Cl. ..... 219/402; 219/390; 219/549

[58] Field of Search ..... 219/390, 388, 219/402, 411, 549, 528, 529, 403, 404, 406, 407, 420, 424

[56] References Cited

U.S. PATENT DOCUMENTS

| | | | |
|---|---|---|---|
| 4,668,478 | 5/1987 | Homer et al. | 422/159 |
| 4,849,608 | 7/1989 | Muraoka et al. | 219/390 |
| 5,095,192 | 3/1992 | McEntire et al. | 219/402 |

*Primary Examiner*—Tu Hoang

*Attorney, Agent, or Firm*—Michael A. Glenn

[57] ABSTRACT

A heating chamber for use in diffusion reactors employed in the semiconductor industry. An inner chamber is formed within an insulative layer. The proximal ends of separators are embedded in this insulative layer with the distal ends extending into the inner chamber. Support rods inserted through holes in the proximal ends and embedded in the layer of insulation secure and align the ceramic separators. The distal end of each ceramic separator has an indentation adapted to restrain a resistance wire at a designated distance from the insulative layer while providing space for wire expansion towards the insulative layer. The wire is preferably restrained at distances of between 0.05 and 24 inches from the insulative layer. The entire assembly is wrapped with additional insulative blankets and enclosed within a stainless steel shell.

17 Claims, 6 Drawing Sheets

HEATING CHAMBER

BACKGROUND OF THE INVENTION

1. Technical Field

This invention relates generally to heating chambers and in particular to a heating chamber for use in diffusion reactors for semiconductor production.

2. Description of the Prior Art

Heating chambers have been in use throughout the history of the semiconductor industry for processing silicon wafers. Heat is generated by means of electrical current passing through resistance wire within the heating chamber. With time and improvement in technology, silicon wafer size has grown to eight inches in diameter, and may grow yet larger in the future. Processing of such larger-sized silicon wafers requires a heating chamber with increased inner and outer diameters. This increase in size amplifies the problems associated with resistance wire and construction of heating chambers. Therefore, better engineered heating chambers with improved reliability and longevity are in demand.

Existing heating chambers are typically made of helically wound or sinuated resistance wire placed in the inner circumference of an insulated heating chamber. Ceramic separators are used to keep the wire from coming in contact with the adjacent turn.

The most common problem associated with heating chambers of this construction is the growth of the resistance wire with usage and time. As this wire heating element cycles between higher and lower temperatures, its linear length increases. With time, this cycling causes continuous wire growth. Prior art designs do not provide any space for growth of the wire heating element. Thus, as linear length increases, the wire is forced to buckle and deform towards the center of the heating chamber. This phenomenon, known as "wire sagging" eventually prevents the insertion of the quartz process tube, and necessitates the replacement of the heating chamber.

FIG. 1 is a partial cross-sectional view of the prior art heating chamber before usage. The heating chamber 1 has a stainless steel outer shell 2 with an inner lining of insulation 4. The wire heating element 6 is held against the insulation lining by ceramic separators 8.

FIG. 2 is a partial cross-sectional view of the prior art heating chamber after usage. Repeated temperature cycling causes the wire heating element to elongate and eventually deform 10 towards the center of the chamber.

Homer et al, *Vertically Positioned Transfer System for Controlling and Initiating the Flow of Metered Amounts of Solid Materials,* U.S. Pat. No. 4,668,478 (May 26, 1987) discloses a hopper with heaters connected to its outer walls. These heaters de-energize when the internal temperature reaches approximately 180°. By contrast, the heating chambers used in silicon wafer processing are designed to operate at temperatures between 100° and 1600° C. Additionally, the heating chambers used in the silicon wafer manufacturing process have internal, rather than external, wire heating elements.

It would therefore be a significant advance in the art to provide a heating chamber and separator designed to accommodate the linear growth of the wire heating elements, and thus extend the useful life of the heating chamber.

SUMMARY OF THE INVENTION

The invention provides a heating chamber for use in diffusion reactors employed in the semiconductor industry.

In the preferred embodiment of the invention, a cylindrical inner chamber is formed within a layer of vacuum-formed insulative material. The proximal ends of ceramic separators are embedded in this insulative layer with the distal ends extending into the inner chamber. Support rods inserted through holes in the proximal ends and embedded in the layer of insulation secure and align the ceramic separators. The distal end of each ceramic separator has an indentation, adapted to retain a resistance wire at a selected distance from the insulative layer, while providing space for wire expansion towards the insulative layer. In the preferred embodiment of the invention, the wire is retained at distances of between 0.05 and 24 inches from the insulative layer. The entire assembly is subsequently wrapped with additional insulative blankets and enclosed within a stainless steel shell. The invention described thus increases heating chamber life by accommodating the growth, with usage, of resistance wire by permitting its radial expansion.

DETAILED DESCRIPTION OF THE INVENTION

Figure 1:
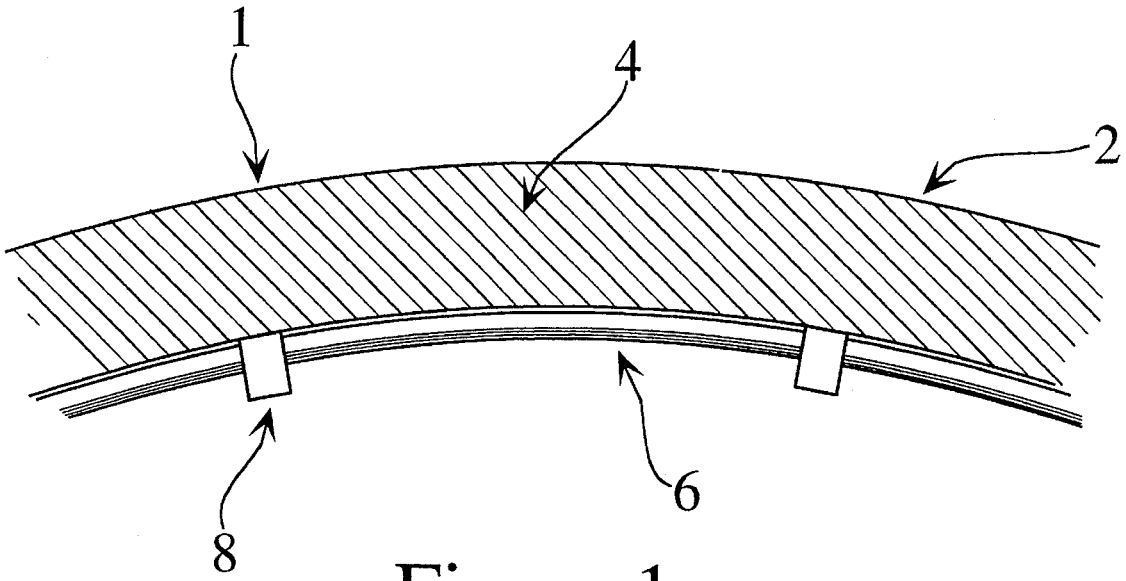
Figure 1 (PRIOR ART)
FIG. 1 is a partial cross-sectional view of the prior art heating chamber before usage.
Figure 2:
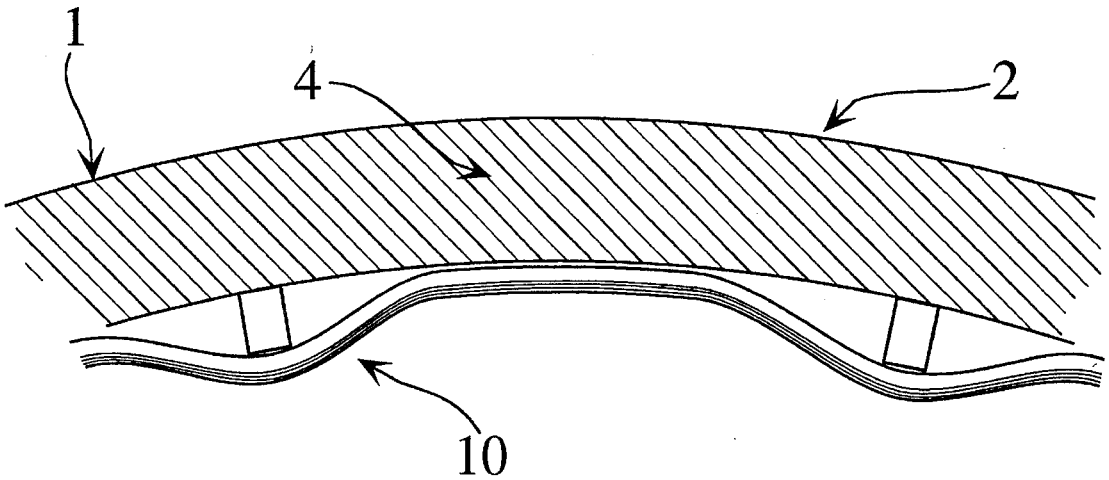
Figure 2 (PRIOR ART)
FIG. 2 is a partial cross-sectional view of the prior art heating chamber after usage.

The invention is best understood by referring to the drawings in connection with review of this description. The invention provides a heating chamber for use in diffusion reactors employed in the semiconductor industry.

Figure 3:
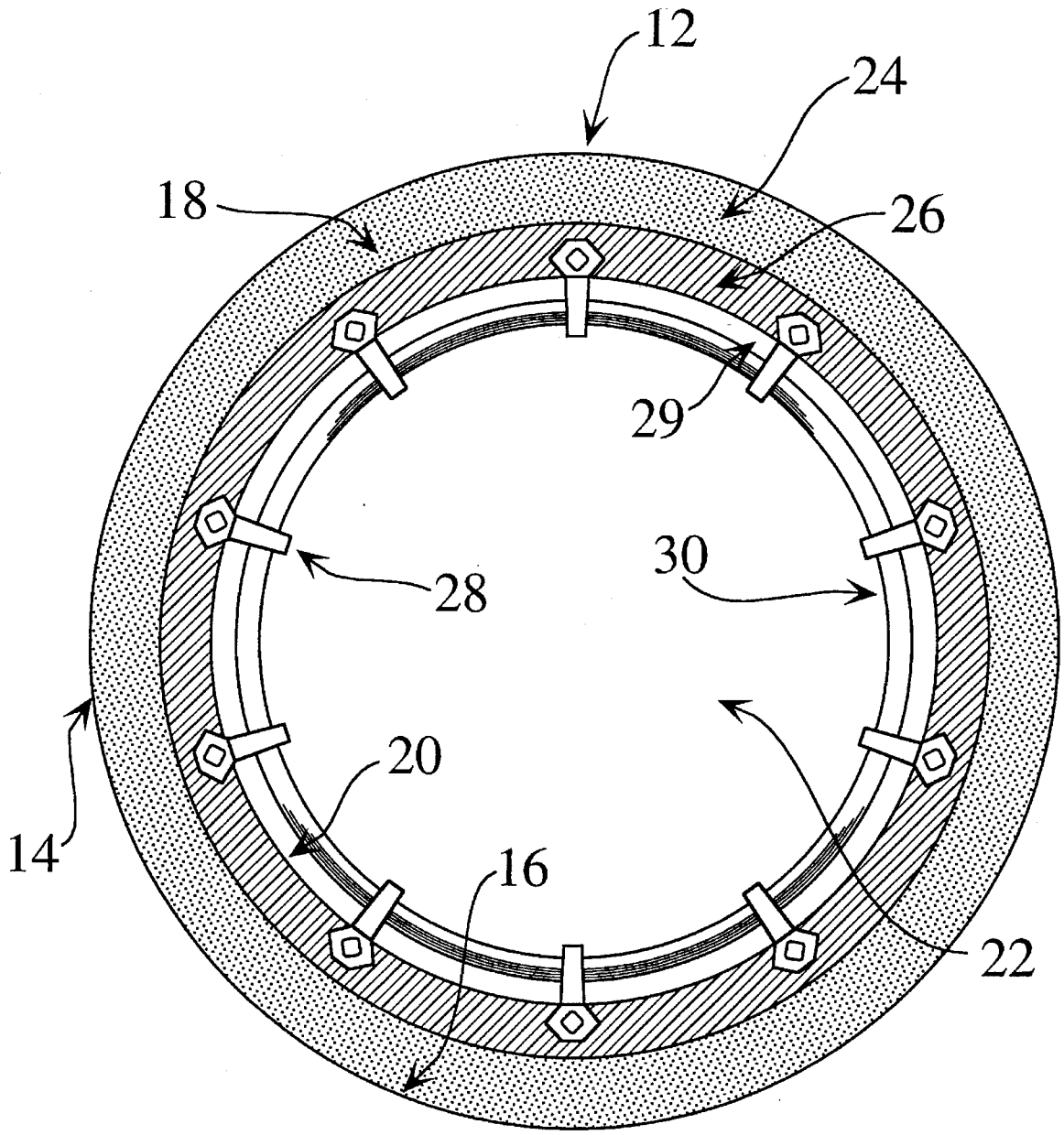
FIG. 3 is a cross-sectional view of the heating chamber of the invention before usage.

FIG. 3 shows a cross-sectional view of the heating chamber of the invention prior to usage. The heating chamber 12 has an outer shell 14 surrounding an insulative layer 18. In this preferred embodiment of the invention, the outer shell is cylindrical in shape; however, the invention is also applicable to other shapes, including but not limited to ovoid or elliptical shells. While preferably stainless steel, this outer shell may also be formed of aluminum or any other material suitable to house the heating chamber.

The insulative layer is disposed along the inner wall 16 of the outer shell to form an insulation wall 20, defining an inner chamber 22. This inner chamber is preferably circular in cross section, though the teachings of the invention also apply to other designs, such as an oval cross-section. In a preferred embodiment of the invention, the insulative layer is formed of a felt blanket insulator layer 24 disposed along the inner wall, with a vacuum-formed insulator layer 26 forming the insulation wall. In alternate embodiments of the invention, this insulative layer is formed of any suitable insulative material, such as entirely of felt blanket or vacuum-formed insulation, or of any suitable combination of materials. Separators 28 projecting from the insulation wall restrain wire heating elements 30 at a designated distance from the insulation wall 29.

Figure 4A:
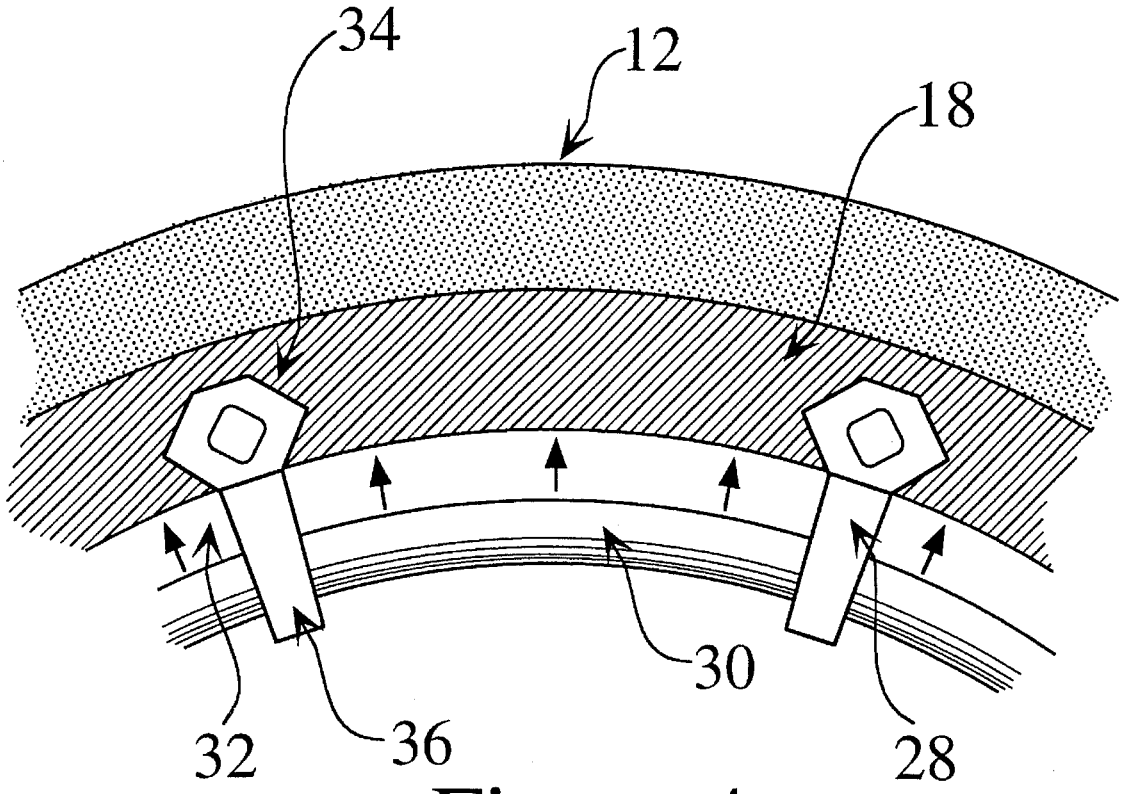
FIG. 4*a* is a partial transverse cross-sectional view of the heating chamber of the invention before usage.

FIG. 4*a* is a partial transverse cross-sectional view of the heating chamber 12 of the invention before usage. The proximal ends 34 of separators are embedded in the insulative layer 18 with the distal ends 36 extending into the inner chamber. While the preferred embodiment of the invention discloses a plurality of separators restraining a helically-wound wire heating element 30, the teachings of the invention are equally applicable to a heating chamber using a single separator and a single wire heating element, or to a chamber in which the wire is wound in a configuration other than a helix. Alternately, a plurality of wires may be disposed within the inner chamber and restrained by the separators. The separators are preferably formed of ceramic, but any other appropriate insulative material may be used.

Figure 4B:
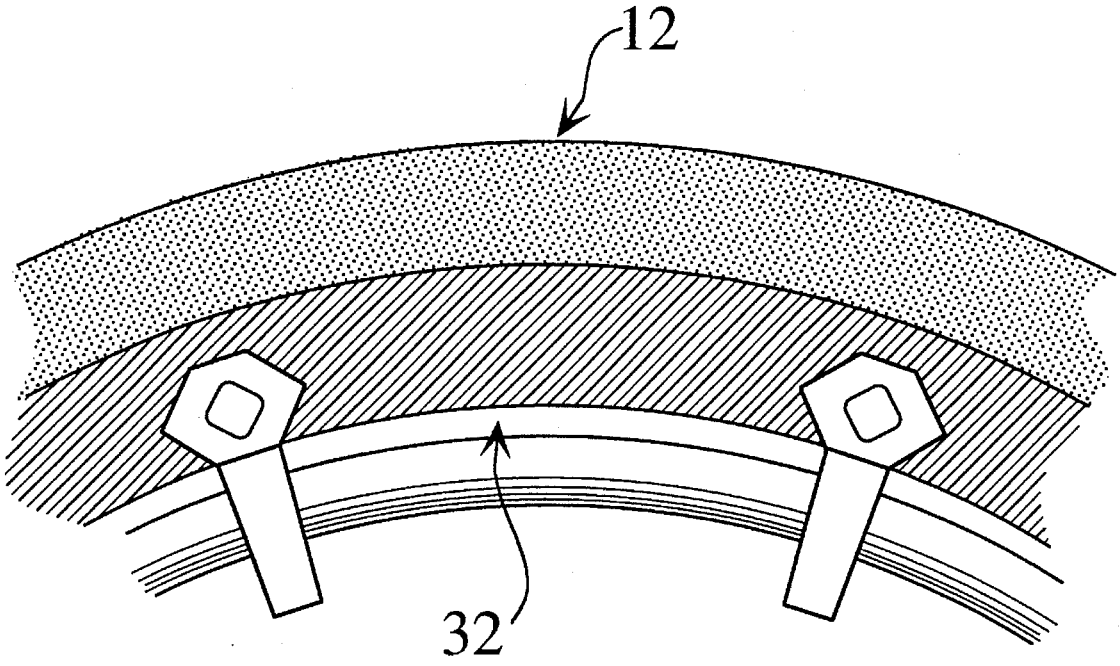
FIG. 4*b* is a partial transverse cross-sectional view of the heating chamber of the invention after usage.

As the heating chamber is used and the wire heating element cycles between higher and lower temperatures, the linear length of the wire increases. The separators provide space for this elongation 32 by restraining the wire heating element at a designated distance from the insulation wall. FIG. 4*b* is a partial transverse cross-sectional view of the heating chamber of the invention after usage, showing the movement of the wire heating element into the space provided for its expansion. By permitting this expansion towards the insulation wall, the separators of the invention reduce the incidence of wire deformation and thus prolong heating chamber life.

Figure 5A:
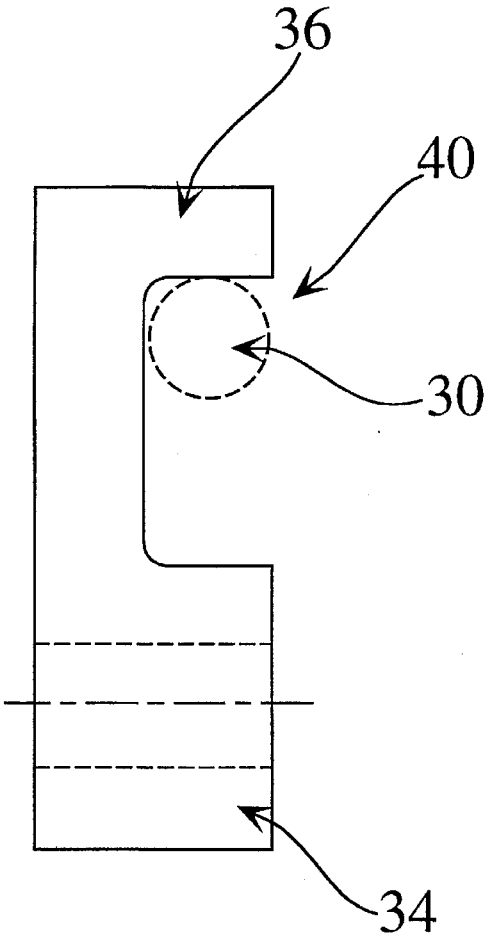
FIG. 5*a* is a sectional side view of the separator of the invention.

FIG. 5*a* is a sectional side view of the separator of the invention. The proximal end 34 of the separator is adapted for embedding in the insulative layer of the heating chamber. The distal end of the separator 36 has an axial indentation 40 adapted to restrain a wire heating element at a designated distance from the insulative layer, while providing space for wire expansion along the indentation and towards the insulator wall. In a preferred embodiment of the invention, the separators restrain the wire heating elements at a distance of between 0.05 to 24 inches from the insulator wall, though this distance is variable in accordance with the needs of the manufacturer.

Figure 5B:
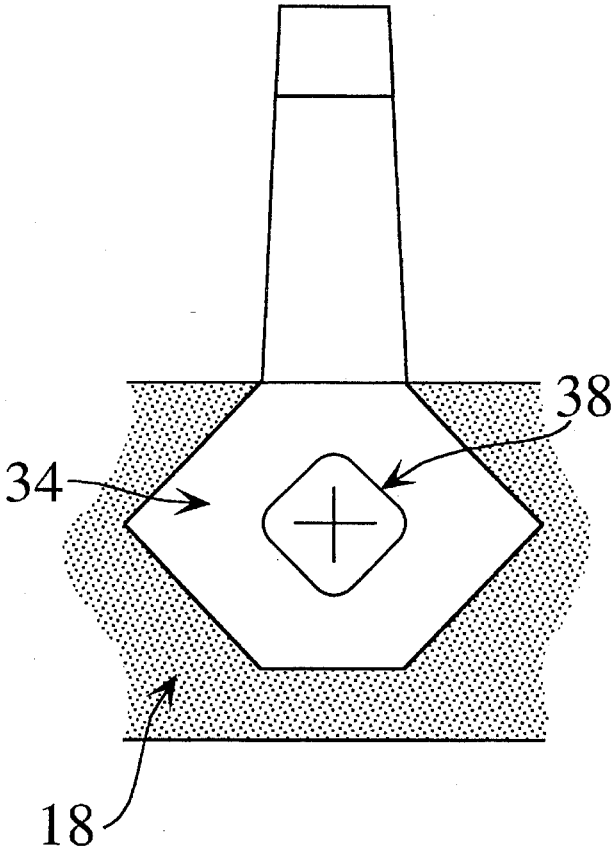
FIG. 5*b* is a top view of the separator of the invention.

FIG. 5*b* is a top view of the separator of the invention, showing the proximal end 34 embedded in the insulative layer 18. In the preferred embodiment of the invention, the proximal end of each separator defines a hole 38 for insertion of a support rod to maintain the separators in spaced alignment.

Figure 6:
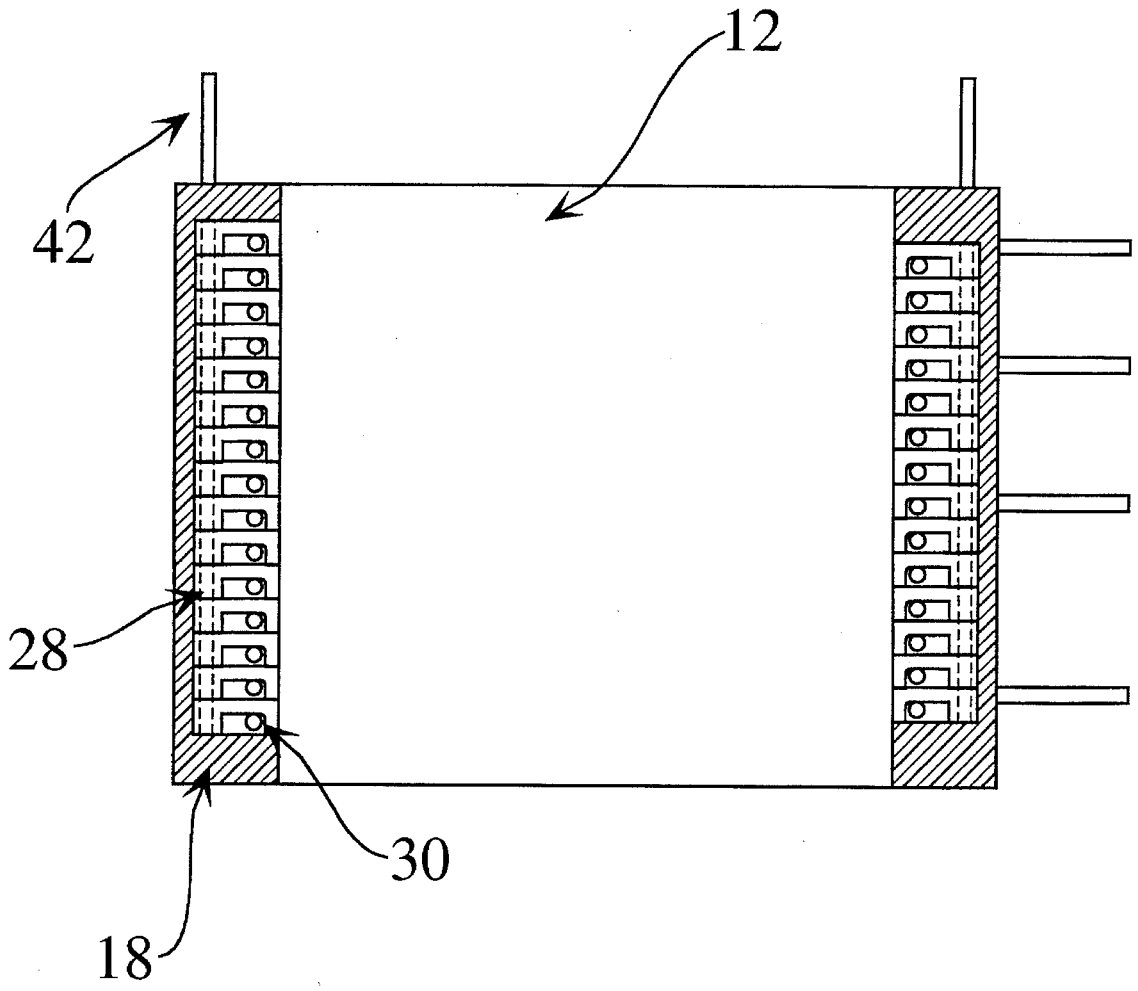
FIG. 6 is a sectional axial view of the vacuum formed section of the heating chamber of the invention.

FIG. 6 shows a sectional axial view of the vacuum formed section of the heating chamber of the invention. Support rods 42 are inserted through the holes in the proximal ends of the separators 28 and embedded in the insulative layer 18 to support and align the separators. The support rods are formed of stainless steel, though may be formed of other metals or rigid materials. The preferred embodiment of the invention discloses one hole through each separator's proximal end for insertion of a single support rod. This support rod extends through a column of separators to maintain their alignment. In alternate embodiments of the invention, a plurality of support rods may be inserted into the holes, or the proximal end may define a plurality of holes. The separators need not be positioned in columns within the heating chamber, but may be arranged to restrain the wire heating element in any desired orientation. The separators may be supported by other means, including but not limited to secure anchoring within the insulator wall or by use of support rods along the sides of the proximal ends.

Figure 7:
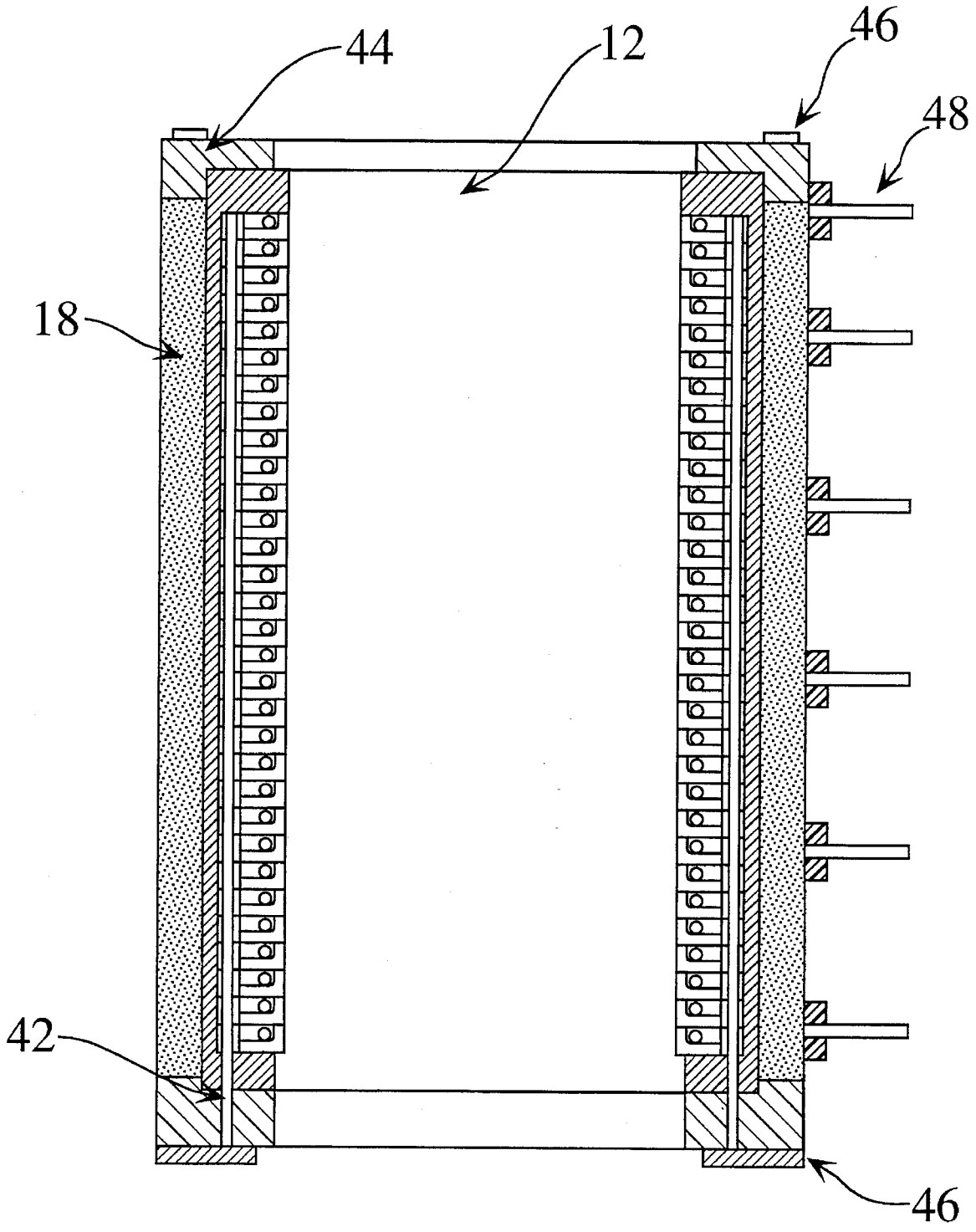
FIG. 7 is a sectional axial view of the completed assembly of the heating chamber of the invention.

FIG. 7 is a sectional axial view of the complete heating chamber of the invention. vacuum-formed end pieces 44, stainless steel rings 46, and terminal bar blocks 48 are added to the outer shell to complete the construction of the heating chamber. The vacuum formed end pieces insulate and add support to the end of the heating chamber. Stainless steel rings secure all the internal pads inside the stainless steel shell. Terminal bar blocks avoid terminal bar contact with the stainless steel shell.

Although the invention is described herein with reference to the preferred embodiment, one skilled in the art will readily appreciate that other applications may be substituted for those set forth herein without departing from the spirit and scope of the present invention. For example, the heating chamber may be used in either vertical, horizontal, of some other orientation. The heating chamber is operable at atmospheric pressure, or at atmospheric pressures of below or above one atmosphere. The wire heating element may be covered by a layer of insulation. The wire may be used for some purpose other than to heat the chamber. The heating chamber of the invention may be used for a variety of process applications other than manufacture of silicon wafers. Accordingly, the invention should only be limited by the claims included below.

I claim:

1. A heating chamber, comprising:

a hollow outer shell with an inner wall;

at least one insulative layer disposed within said outer shell and along said inner wall to form an insulation wall defining an inner chamber;

at least one wire heating element; and at least one separator with a proximal end embedded within said at least one insulative layer, and a distal end projecting into said inner chamber, said distal end having an axial indentation adapted to provide space for said wire heating element to move and expand within a designated distance range from said insulation wall.

2. The heating chamber of claim 1, wherein said outer shell is composed of stainless steel.

3. The heating chamber of claim 1, wherein said insulative layer is vacuum-formed.

4. The heating chamber of claim 1, wherein said insulative layer comprises at least one felt blanket.

5. The heating chamber of claim 1, wherein said insulative layer comprises both vacuum-formed and felt blanket insulators.

6. The heating chamber of claim 1, wherein said at least one separator is ceramic.

7. The heating chamber of claim 1, wherein said heating chamber operates in a vertical orientation.

8. The heating chamber of claim 1, wherein said distance range is from 0.05 inches to 24 inches from said insulation wall.

9. The heating chamber of claim 1, wherein said proximal end of said at least one separator defines at least one hole.

10. The heating chamber of claim 9, further comprising at least one support rod dimensioned for insertion within said hole in said proximal end of said separator to provide separator support and alignment.

11. The heating chamber of claim 10, wherein said at least one support rod is stainless steel.

12. The heating chamber of claim 10, wherein said at least one support rod is embedded within said insulative layer.

13. The heating chamber of claim 1, wherein said heating chamber operates in a horizontal orientation.

14. The heating chamber of claim 1, wherein said heating chamber operates at atmospheric pressure, and at pressures above and below one atmosphere.

15. A separator having an axis, comprising:

a proximal end adapted for embedding into a surface wherein said proximal end defines a hole through said separator and normal to the axis of said separator; and a distal end with an axial indentation adapted to provide space for a wire to move and to expand axially while maintaining said wire within a distance of 0.05 inches to 24 inches from said embedded proximal end.

16. The separator of claim 15, wherein said separator is ceramic.

17. A method for producing heating chamber, comprising the steps of:

disposing at least one insulative layer within the inner wall of a hollow shell to form an inner chamber;

placing at least one resistance wire within said inner chamber; and embedding the proximal end of at least one separator in said insulative layer such that the distal end of said separator projects into said inner chamber and maintains said resistance wire within a designated distance range from said insulative layer while permitting said resistance wire to move and expand.

* * * * *